US005581152A

United States Patent [19]

Matsuno et al.

[11] Patent Number: 5,581,152

[45] Date of Patent: Dec. 3, 1996

[54] DIELECTRIC BARRIER DISCHARGE LAMP

[75] Inventors: Hiromitsu Matsuno; Tatsushi Igarashi, both of Himeji; Tatsumi Hiramoto, Tokyo; Fumitoshi Takemoto, Himeji; Nobuyuki Hishinuma, Himeji; Yasuo Oonishi, Himeji; Kunio Kasagi, Himeji; Takashi Asahina, Takasago; Yasuhiko Wakahata, Himeji, all of Japan

[73] Assignee: Ushiodenki Kabushiki Kaisha, Japan

[21] Appl. No.: 303,033

[22] Filed: Sep. 8, 1994

[30] Foreign Application Priority Data

| | | | |
|---|---|---|---|
| Sep. 8, 1993 | [JP] | Japan | 5-246097 |
| Sep. 8, 1993 | [JP] | Japan | 5-246099 |
| Sep. 14, 1993 | [JP] | Japan | 5-250979 |

[51] Int. Cl.[6] ..... H01J 61/067

[52] U.S. Cl. ..... 313/634; 313/113; 313/574; 313/607; 313/586; 313/631; 313/234

[58] Field of Search ..... 313/634, 113, 313/574, 607, 609, 586, 622, 623, 624, 631, 643, 231.71, 234, 17, 21, 44, 46, 45, 49, 50, 318.01; 174/65 R; 439/602, 609, 611; 422/186.07, 186.18, 186.20, 186.21, 186.24, 186.25, 186.30, 907; 204/178, 164

[56] References Cited

U.S. PATENT DOCUMENTS

| | | | |
|---|---|---|---|
| 3,150,070 | 9/1964 | Ogawa | 422/186.18 X |
| 4,232,229 | 11/1980 | Tanaka et al. | 422/907 X |
| 4,837,484 | 6/1989 | Eliasson et al. | 313/634 |
| 4,851,734 | 7/1989 | Hamai et al. | 313/607 X |
| 5,006,758 | 4/1991 | Gellert et al. | 313/634 |
| 5,386,170 | 1/1995 | Kogelschatz | 313/607 X |

FOREIGN PATENT DOCUMENTS

| | | |
|---|---|---|
| 2-7353 | 1/1990 | Japan . |

*Primary Examiner*—Louis M. Arana
*Assistant Examiner*—Ashok Patel
*Attorney, Agent, or Firm*—Sixbey, Friedman, Leedom & Ferguson, P.C.; David S. Safran

[57] ABSTRACT

In a dielectric barrier discharge lamp, in which a discharge vessel, in which a discharge gas forming "excimer" molecules is encapsulated, is provided with a dielectric provided with a netlike electrode and a window, through which the light goes, the first object of the invention is achieved by an arrangement in which a thickness of ends of the above-described netlike electrodes is greater than the average thickness of the entire electrode. Another object of the invention is achieved by an arrangement in which a holder incorporated in the discharge vessel has an outer dimension that is less than/equal to an outer dimension of the netlike electrodes. A further object of the invention is achieved by an arrangement by which the discharge vessel has a hollow cylindrical shape formed from an external tube and an internal tube and a means for hermetic sealing is arranged inside the internal tube.

19 Claims, 5 Drawing Sheets

DIELECTRIC BARRIER DISCHARGE LAMP

BACKGROUND OF THE INVENTION

1. Field of the Invention

The invention relates to a so-called dielectric barrier discharge-lamp, which is used, for example, as an ultraviolet light source for a photochemical reaction, and in which light radiated from "excimer" molecules, which are formed by a dielectric barrier discharge, is used.

2. Background of the Disclosure

As generic art, a radiator, i.e., a dielectric barrier discharge lamp, is known, for example, from JP laid-open specification HEI 2-7353 or U.S. Pat. No. 4,837,484, in which a discharge vessel is filled with a discharge gas forming "excimer" molecules and in which "excimer" molecules are formed by a dielectric barrier discharge, which is also designated as ozone production discharge or as silent discharge, as is described in "Discharge Handbook," Electrogesellschaft (Electric Company), June 1989, 7th Edition, page 263. In the radiator, light is radiated from the "excimer" molecules.

In the above-named publications, an arrangement of a dielectric barrier discharge lamp is described, in which the discharge vessel has a cylindrical shape and functions at least partially also as dielectric of the above-described dielectric barrier discharge, which is at least partially transparent relative to the light radiated from the above-described "excimer" molecules. In this discharge lamp, further, the above-described light-transmitting dielectric is provided at least partially with netlike electrodes.

Further, another design of a dielectric barrier discharge lamp is known, which has an approximately cylindrical outer shape as well as an overall hollow cylindrical discharge vessel, in which an external tube and an internal tube are arranged coaxially to one another, a discharge space exists between the external tube and the internal tube and a hollow space is formed inside the internal tube.

The above-described dielectric barrier discharge lamps have various advantages, which neither conventional low-pressure mercury discharge lamps nor conventional high-pressure arc discharge lamps have, such as, for example, a radiation of ultraviolet rays with short waves, in which main wavelengths lie at 172 nm, 222 nm and 308 nm, and at the same time a selective production of light with individual wavelengths with a high efficiency, which are, for example, line-spectrum-like.

However, a conventional dielectric barrier discharge lamp had the drawback that a space uniformity of light output, a time stability and a light yield were not always obtained to a sufficient degree.

Further, it was regarded in this connection as disadvantageous that despite the lamp arrangement that is completely different from the conventional low-pressure mercury discharge lamp or the conventional high-pressure arc discharge lamp, no adequate examination of a coefficient of utilization of the light or of a maintenance of the lamp was performed.

Such a dielectric barrier discharge lamp is used for reforming plastic surfaces, for forming layers or for similar purposes, and it is often used within an atmosphere in addition to air, such as, for example, within an atmosphere of nitrogen, argon, oxygen or the like. In this connection, however, it was regarded as disadvantageous that:even though a dielectric barrier discharge lamp of hollow cylinder type allowed to linger in the air is introduced in a nitrogen atmosphere, air present inside the internal tube forming the hollow cylinder is emitted by steps in the nitrogen within a short time, without being substituted with the nitrogen, and without the nitrogen atmosphere being contaminated by the air.

In this case, a suitability because of a high reliability is achieved, if the netlike electrodes arranged in the external tube are put on an earth potential and a high voltage is applied to the electrodes arranged in the internal tube. But in this case, it is regarded as disadvantageous that dust accumulates on the electrodes and that the accumulated dust precipitates as a mass on an object to be treated and contaminates it, since the electrodes, to which the high voltage is applied, have a dust-catching effect.

The above-described drawbacks are characteristic for a dielectric barrier discharge lamp, which has a hollow cylindrical discharge space, which is designed so that an external tube as well as an internal tube with approximately cylindrical outer shapes are arranged coaxially to one another. These drawbacks occur especially when using the dielectric barrier discharge lamp for the purpose of a photochemical reaction.

SUMMARY OF THE INVENTION

A first object of the invention is therefore to indicate a dielectric barrier discharge lamp, which has at its disposal an advantageous (good) space uniformity of the light output, an advantageous time stability and at the same time a high light yield.

A second object of the invention consists in indicating a dielectric barrier discharge lamp, which has a high light coefficient of utilization and at the same time a simple maintenance of the lamp.

A third object of the invention consists in indicating a dielectric barrier discharge lamp, which has a hollow cylindrical discharge space, which is designed so that an external tube as well as an internal tube with approximately cylindrical outer shapes are arranged coaxially to one another, and in which no contamination of a given atmosphere by air or the like for using the above-described discharge lamp occurs and thus a high reliability is achieved.

The first object is achieved according to the invention in that in a dielectric barrier discharge lamp, in which a discharge vessel is filled with a discharge gas forming "excimer" molecules by a dielectric barrier discharge, in which the above-described discharge vessel functions at least partially also as dielectric of the above-described dielectric barrier discharge and is at least partially transparent relative to the light radiated from the above-described "excimer" molecules, and in which the above-described dielectric is provided at least partially with electrodes, a means is arranged by which a thickness of electrode ends of the above-described electrodes is greater than the average thickness of the above-described electrodes.

The first object of the invention is further advantageously achieved in that for the above-described means, the above-described electrode ends are wrapped with a wire, a twisted wire, a metal strip, and/or a strip made of metal netting.

The first object of the invention is also advantageously achieved in that ends of seamless, cylindrical, netlike electrodes, which have a resilience in axial direction of the above-described discharge lamp, are folded.

Moreover, the first object of the invention is advantageously achieved in that an electrode lead is connected to the wire, the twisted wire, the metal strip and/or the strip made of metal netting, with which the above-described electrode ends are wrapped, or in that a conductive paste is applied to the ends of the above-described electrodes.

The second object is achieved according to the invention in that in a dielectric barrier discharge lamp, in which a discharge vessel with an approximately cylindrical outer shape is filled with a discharge gas forming "excimer" molecules by a dielectric barrier discharge, in which an outer wall of the above-described discharge vessel is at least partially transparent relative to the light radiated from the above-described "excimer" molecules and at the same time also functions as dielectric of the above-described dielectric barrier discharge, and in which the above-described light-transmitting dielectric is provided at least partially with electrodes, at least on one end of the above-described discharge vessel, a holder is arranged whose outer diameter is less than/equal to an outer diameter of the above-described electrodes.

The second object of the invention is further advantageously achieved in that the above-described holder has an air outlet orifice to cool the lamp.

Moreover, the second object of the invention is advantageously achieved in that the above-described holder-consists of silicone rubber or fluororesin.

The third object is achieved according to the invention in that in a dielectric barrier discharge lamp, in which a discharge vessel with a hollow cylindrical discharge space, which is designed so that an external tube as well as an internal tube with approximately cylindrical outer shapes are arranged coaxially to one another, is filled with a discharge gas forming "excimer" molecules by a dielectric barrier discharge, in which an outer wall of the above-described external tube is at least partially transparent relative to the light radiated from the above-described "excimer" molecules and at the same time also functions as dielectric of the above-described dielectric barrier discharge, and in which the above-described light-transmitting dielectric is provided at least partially with electrode, a means for hermetic sealing of an interior of the above-described internal tube is arranged.

The third object of the invention is further advantageously achieved in that the above-described means for hermetic sealing also functions as a holder of the above-described dielectric barrier discharge lamp, in that ceramic or resin is bonded to the above-described discharge vessel for the above-described means for hermetic sealing, in that a component that consists of a material that is approximately the same, such as the material of the internal tube, is applied in the above-described discharge vessel as precipitate (deposition) for the above-described means for hermetic sealing, or in that the above-described means for hermetic sealing consists of silicone rubber and hermetically seals the above-described internal tube.

The third object of the invention is also achieved in that the means for hermetic sealing off of an end of the above-described internal tube is selected from the above-named means and at the same time identical means are used for hermetic sealing off of one and of the other end, or in that the interior of the above-described internal tube is hermetically sealed by filling the interior of the above-described internal tube with silicone rubber.

Moreover, the third object of the invention is achieved in that a hermetically sealed part is arranged at least on one end for the means for hermetic sealing of the above-described internal tube, in which a metal foil is inserted, by which (electrical) energy is fed to the above-described aluminum electrodes.

With respect to the first object of the invention, the inventors have discovered the following:

A dielectric barrier discharge consists of a multiplicity of microscopically small discharge plasmas with a very small plasma diameter and at the same time a very short discharge period, which are designated below as microplasmas, as is described in the above-named "Discharge Handbook." In the dielectric barrier discharge lamp, a stability of the light output, a space uniformity as well as a light yield are influenced by electrode ends incorporated in a dielectric. These objects can be achieved by an arrangement in which a thickness of the electrode ends is greater than the average thickness of the above-described electrodes.

The reaction process for improvement of the above-described time stability of the light output, space uniformity as well as the light yield, is not quite completely explained, but it functions presumably as follows:

Electrodes are basically thin and tend to have a nonuniform and great field strength on their ends, since the ends are often shaped knife-edge-like or needle-like. A creep-discharge-like discharge as well as a multiplicity of microplasmas develop in an intensive way on the ends of the electrodes, therefore not in a discharge gas but in an atmospheric gas, such as air or the like. As a result, the discharges become unstable, the light output on the electrode ends is great, i.e., a time fluctuation of the light output is great and the space uniformity of the light output deteriorates. Further, the light yield also drops, if a creep-discharge-like discharge or an excessively intensive production of microplasmas develops in an atmospheric gas, such as air or the like.

By the arrangement for achieving the first object of the invention, the intensification of the field strength on the electrode ends is reduced, and becomes relatively uniform and the field strength also becomes weak. As a result, the space uniformity of the light output, the time fluctuation of the light output as well as the light yield are improved.

Further, the thickness of the electrode ends can be increased in a simple and at the same time uniform way by the measure by which the electrode ends are wrapped with a wire, twisted wire, metal strip, or strip made of metal netting or several of them, or by which the above-described electrode ends are folded.

Moreover, a dielectric barrier discharge lamp with high reliability can be obtained by the measure according to the invention in which an electrode lead is connected to the wire or the like, with which the above-described electrode ends are wrapped, since the connection of the above-described electrodes is performed with high mechanical strength and reliability.

According to the invention, no unnecessary discharge results even by the arrangement by which as electrodes, seamless, cylindrical, netlike electrodes are arranged, which have a resilience in axial direction of the lamp, since the radius of the above-described netlike electrodes is reduced, comes to lie with the dielectric head to head, adjoining one another completely tightly, and thus no hollow space is formed in a part if the netlike electrodes are pulled in axial direction, after the discharge vessel was inserted in them. As a result, a production of harmful compounds in the area surrounding the lamp is prevented because of this unnecessary discharge and at the same time a stable discharge and thus a stable light output are obtained and the light yield is increased. This means that a dielectric barrier discharge lamp can be obtained, which has a space-uniform discharge, a stable discharge as well as a stable light output, since the above-described netlike electrodes on a surface of the approximately cylindrical dielectric have a sufficient uniformity, without an overlapping resulting, as in the formation of a suture line by bunching of the netlike electrodes.

According to the invention, furthermore, by the measure in which a conductive paste is applied to the electrode ends, whose main component is silver, gold, nickel, carbon or the like, the thickness of the electrode ends can be increased in a simple way and with any shape and thus the uniformity of the field strength can be largely improved.

If the conductive paste is applied to the component with which the electrode ends are wrapped, such as wire or the like, a dielectric barrier discharge lamp with a high reliability can be obtained, since the connection of the above-described electrodes is performed with an even higher mechanical strength and reliability.

For the second object of the invention, the inventors have performed detailed tests with respect to a light coefficient of utilization of a conventional dielectric barrier discharge lamp and have discovered that the light coefficient of utilization is linked with a maintenance of the dielectric barrier discharge lamp and is influenced to a great extent especially by an arrangement of the holder arranged on the ends of the above-described lamp. The inventors have further discovered that the light coefficient of utilization decreases if an outer diameter of the holder is larger than the outer diameter of the above-described electrodes and that the reason for this lies in a distribution of light which is characteristic for a cylindrical dielectric barrier discharge lamp.

FIG. 11 shows diagrammatically a light distribution. In the representation, a broken line designates a light distribution of a rod-shaped fluorescent lamp or halogen lamp. It is a circular curve 21 with a light output in a direction perpendicular to an axis of the lamp tube, i.e., in a direction in which, based on cosine $\Theta$, angle $\Theta=\pi/2$, as diameter. A solid line illustrates a light distribution of a dielectric barrier discharge lamp. It represents a curve 22, in which the light output in a range, in which $\Theta$ lies around 0 as well as $\pi$, is greater than the circular distribution.

This means that in the dielectric barrier discharge lamp, the ratio of light, which is radiated in a direction adjacent to the axis of the lamp tube, is larger in comparison to a fluorescent lamp or the alike, and that therefore the light radiated in this direction is turned off by the holder and a reduction of a degree of light output, i.e., of the light coefficient of utilization, occurs if the outer diameter of the holder is greater than the outer diameter of the above-described electrodes. Such a phenomenon, that decreases because of an arrangement of the holders of the light output, i.e., the light coefficient of utilization, is a phenomenon typical of a cylindrical dielectric barrier discharge lamp.

By the arrangement for achieving the second object of the invention, the above-described lamp can be incorporated in another component and positioned there without reducing the light coefficient of utilization and simultaneously in a simple and exact way.

Further, a simple cooling of the lamp by the arrangement of an air outlet orifice for cooling the lamp can be achieved in the holders and thus a dielectric barrier discharge lamp with a high efficiency can be obtained in a simple way.

Moreover, because of an elasticity of this material, a simple incorporation in the ends of the discharge vessel is achieved by the measure in which the above-described holder consists of silicone rubber or fluororesin. In this connection, there is the further advantage that the leads connected to the electrodes can be tapped in a simple way.

By the term "holder" in the invention, an arrangement is to be understood, which independently of the discharge vessel of the dielectric barrier discharge lamp is used to hold the lamp and is fastened to the discharge vessel by gluing with an adhesive or the like, by injection or the like.

Further, the term "outer diameter of the above-described electrodes" in the invention is to be understood to mean an outer diameter of the netlike electrodes, which was measured in a state in which the electrodes were incorporated in the discharge vessel.

An outer diameter of the above-described electrodes can be calculated if a cylindrical netting produced by crossing litz wires with diameters of d mm is placed on a discharge vessel with a diameter of D mm, taking into consideration an "overlapping" of the litz wires by a sum of 4×d and D.

By the arrangement for achieving the third object of the invention, the following advantages can be achieved:

A contamination of the given atmosphere by another gas, such as air or the like, occurs only in a few cases, since the gas present inside the internal tube, such as air or the like, does not flow out toward the outside.

A contamination of the object to be treated no longer occurs, since no more air flows on the electrodes, to which a high voltage was applied, and therefore no dust accumulates.

The term "hermetic sealing" in the invention is to be understood to mean a hermetic sealing, which is not complete, like a vacuum resistance, but is a sealing by a usual inorganic adhesive or an adhesive based on silicone rubber to be able to prevent a flowing out of water.

By the arrangement according to the invention, in which a component for the hermetic sealing of at least an inside of the above-described internal tube also functions as a holder of the above-described dielectric barrier discharge lamp, a light and at the same time reasonably-priced dielectric barrier discharge lamp can be obtained, since only a small amount of components is needed.

Further, the advantage is obtained that the electrode leads, to which the high voltage is applied with a high frequency, can be tapped in a safe and simple way by the measure by which the means for hermetic sealing of at least one end of the above-described internal tube is arranged so that a material, in which one of the materials ceramic or resin or several of these materials is/are selected, is glued to the above-described discharge vessel, to hermetically seal the interior of the internal tube.

According to the invention, a more compact hermetically sealed part and at the same time a high hermetically closing property are also achieved by the measure by which the internal tube is hermetically sealed so that a component, which consists of a material that is approximately the same, such as the material of the internal tube, is deposited in the above-described discharge vessel as deposition, and the flowing out of the gas, such as air or like, hardly occurs any more, if, for example, glass is deposited in the discharge vessel as deposition, if the discharge vessel consists of glass.

Moreover, a simpler closing process can be achieved by the arrangement according to the invention, in which the above-described internal tube is hermetically sealed by a direct injection of the silicone rubber in an end of the above-described internal tube. In this connection, a reasonably-priced dielectric barrier discharge lamp with a good hermetic sealing property can be obtained at the same time, since the silicone rubber has good adhesive properties as well as ultraviolet radiation resistance.

According to the invention, a largely simplified sealing process can furthermore be achieved by the measure by which the means for hermetic sealing of an end of the above-described internal tube is selected from the above-named means and at the same time identical means can be used for hermetic sealing of one end and of another end, and an even more reasonably-priced dielectric barrier discharge lamp can be obtained.

Further, a dielectric barrier discharge lamp with an even higher reliability can be obtained by the measure according to the invention in which the interior of the above-described internal tube is hermetically sealed by filling the entire space of the interior of the above-described internal tube with silicone rubber, since no more air is present inside the dielectric barrier discharge lamp and thus the problem of leakage in the hermetically sealed part no longer occurs.

Below, the invention is further described based on the embodiments represented in the drawings.

DETAILED DESCRIPTION OF THE PREFERRED EMBODIMENTS

Figure 1:
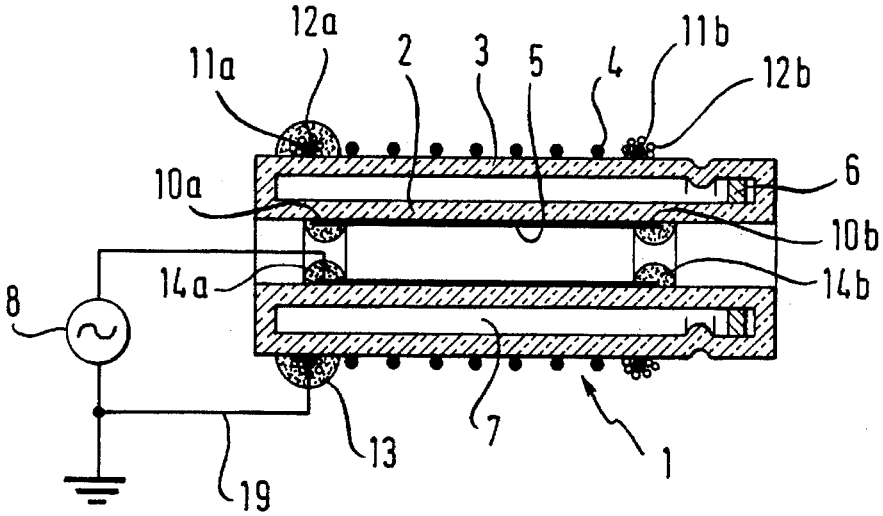
FIG. 1 is a diagrammatic representation of an embodiment of the dielectric barrier discharge lamp according to the invention.

First, embodiments for achieving the first object of the invention are shown in FIG. 1:

In the representation, a reference symbol 1 designates a discharge vessel, which is shaped like a hollow cylinder so that an internal tube 2 made of synthetic quartz glass and an external tube 3 made of synthetic quartz glass are arranged coaxially to one another. Discharge vessel 1 actually has, for example, a total length of about 150 mm, an outer diameter of the internal tube of 14 mm, an inner diameter of the external tube of about 25 mm as well as a thickness of 1 mm.

On its outer surface, internal tube 2 has an aluminum electrode 5, which also functions as a light-reflector disk. A barium getter 6 is arranged on one end of discharge vessel 1. Electrode 5 is formed by cathode sputtering and has a thickness of, for example, 0.005 mm. External tube 3 also functions as a dielectric of a dielectric barrier discharge as well as a light exit window and has a netlike electrode 4 on its outer surface.

Figure 2:
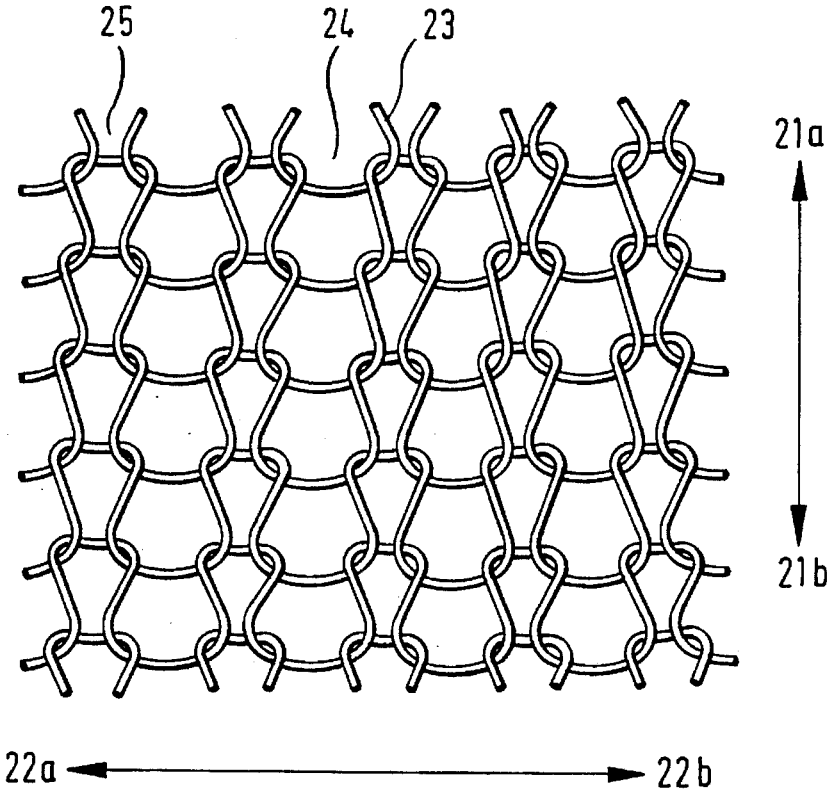
FIG. 2 is a diagrammatic representation of netlike electrodes of the dielectric barrier discharge lamp according to the invention.

Netlike electrode 4, as partially illustrated in FIG. 2, is designed so that a metal wire 23 is made knitted seamless and cylindrical and loops are repeatedly made in peripheral direction 22*a*–22*b* of the cylinder. Metal wire 23 consists, for example, of monel with a litz wire diameter of 0.1 min.

A large mesh 24 and a small mesh 25 have an area of about 2 $mm^2$ and an area of about 1 $mm^2$, respectively. Netlike electrode 4, which is arranged head to head tightly adjoining one another on an outer side of external tube 3, is designed so that discharge vessel 1 is inserted in this cylindrical metal netting and is pulled in axial direction of the lamp. By this arrangement, netlike electrode 4 is arranged on external tube 3 head to head tightly adjoining one another.

The cylindrical netlike electrode has an outer diameter of, for example, about 27.4 mm. For electrode 4, a conductive, netlike electrode is thus used in a suitable way. But it is also possible to design electrode 4 from a light-transmitting thin layer.

Xenon gas is encapsulated as discharge gas with a pressure of, for example, 300 torrs in a discharge space 7 of discharge vessel 1. For example, in a discharge with an output of 2ω/om lamp, by using a source of current 8 with a frequency of 20 KHz, ultraviolet rays with a wavelength of 172 nm and in the range of this wavelength were radiated with high efficiency. A gap of discharge space 7 lies, for example, at 5.5 min.

Ends 11*a* and 11*b* of net-like electrode 4 were wrapped with rust-free wires 12*a* and 12*b* with a diameter of, for example, about 0.1 mm in axial direction of the lamp over a length of, for example, about 3 mm. An electrode lead 19 was connected to rust-free wire 12*a*, to which a silver paste 13 was applied in a thickness of about 0.5 min. Silver pastes 14*a* and 14*b*, for example, were applied in a thickness of about 0.5 mm and in a length of 5 mm to ends 10*a*, 10*b* of interior electrode 5.

A uniformity of the field strength in axial direction of the lamp can be achieved by the above-described measure, in which the rust-free wires are added to the electrode ends and thus the thickness only of the ends of the electrodes is increased and an average thickness of the electrode ends is greater than the average thickness of the entire electrode. A dielectric barrier discharge lamp can therefore be obtained, in which the space uniformity of the light output, the time fluctuation of the light output as well as the light yield are improved.

The term "electrode end" is to be understood to mean a part of an electrode, which extends from an end part of the electrode, i.e., from a part in which the electrode comes to an end along the dielectric of the dielectric barrier discharge, in a length which is less than/equal to a length of the discharge gap of the dielectric barrier discharge.

As means which is added to increase the thickness of the electrode ends, wire, twisted wire, metal strips and/or strips made of metal netting is/are used.

Figure 3:
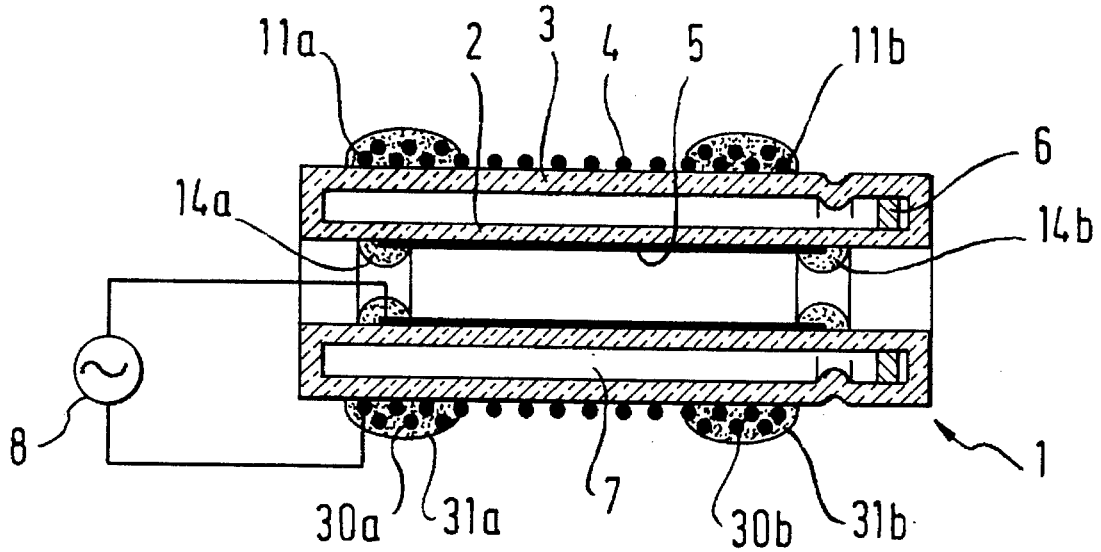
FIG. 3 is a diagrammatic representation of another embodiment of the dielectric barrier discharge lamp according to the invention.

In FIG. 3, another means is shown, by which the average thickness of the electrode ends becomes greater than the average thickness of the entire electrode. In this case, netlike electrode 4 was bent on its ends 11*a* and 11*b*, so that they come to lie on one another and folds 30*a* and 30*b* are formed, to which nickel pastes 31*a* and 31*b*, for example, were applied in a thickness of about 1 mm. By bending or folding the electrodes on their ends, an average thickness of the electrode ends greater than the average thickness of the entire electrodes can be achieved. As a result, an improvement of the space uniformity of the light output, the time fluctuation of the light output as well as the light yield can be achieved.

Figure 4:
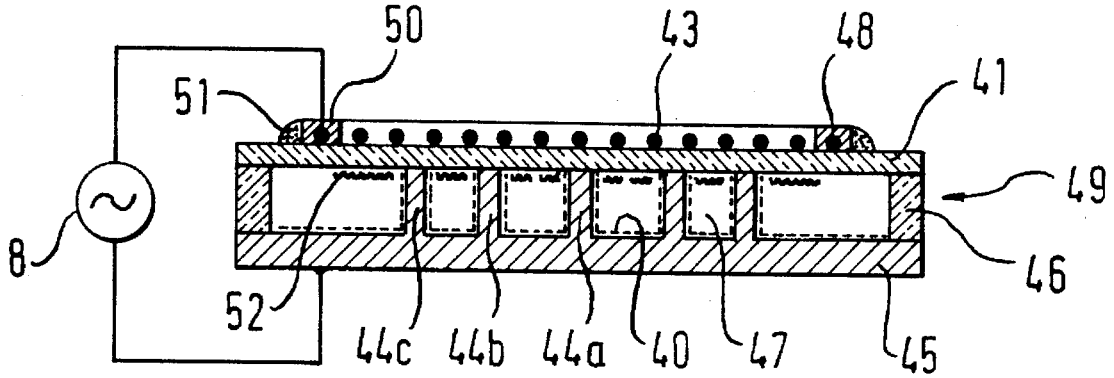
FIG. 4 is a diagrammatic representation of still another embodiment of the dielectric barrier discharge lamp according to the invention.

FIG. 4 illustrates another embodiment. In this embodiment, no hollow-cylindrical arrangement is shown, in which an internal tube and an external tube are arranged coaxially to one another, as in the above-described embodiment.

A disklike discharge vessel 49 is made from a platelike dielectric 41 made of synthetic quartz glass, a platelike discharge vessel component 45 made of aluminum as well as cylindrical quartz glass 46. Platelike dielectric 41 has, for example, a diameter of 100 mm and a thickness of 1.5 mm.

Dielectric 41 functions both as dielectric for a dielectric barrier discharge and as light exit window component and has on its outer surface a metallic, netlike electrode 43 with a diameter of 80 mm, which is designed so that rust-free litz wires with a diameter of about 0.1 mm are knitted at a distance of, for example, 2 mm by orthogonal crossing.

Inner electrodes consist of an electrode 44*a* made of an aluminum rod, Which is incorporated in the center of above-described vessel component 45, as well as of electrodes 44*b* and 44*c* made of aluminum rings in the area surrounding electrode 44*a*. The electrodes each have a diameter of, for example, 1 mm.

Electrodes 44*a*, 44*b* and 44*c* also function as reinforcing component against an atmospheric pressure of dielectric 41. Electrodes 44*a*, 44*b* and 44*c* adjoin dielectric 41, but are not mechanically fastened in dielectric 41. Parts of electrodes 44*a*, 44*b*, 44*c*, as well as of vessel component 45, opposite the discharge space, are covered with a dielectric 40 consisting of $MgF_2$.

A rust-free ring 50, for example, with an inner diameter of 75 mm, an outer dimension of 85 mm and a height of 2 mm was arranged on an electrode end 48 of netlike electrode 43 by an electric contact with netlike electrode 43. Ring 50 was fastened by an adhesive based on silicone rubber 51 to dielectric 41.

As discharge gas, xenon gas was encapsulated with, for example, 350 torrs in a hollow space 47, and an alternating voltage was applied by source of current 8 between electrodes 43, 44*a*, 44*b* and 44*c*. In this connection, a creep discharge plasma 52 was produced near dielectric 41 and ultraviolet rays were radiated with a high efficiency from "excimer" molecules of xenon, which have a maximum value at a wavelength of 172 nm and in the range of this wavelength.

Also in this case, an average thickness of the electrode ends greater than average thickness of the entire electrode is achieved by an addition of rust-free ring 50 in electrode end 46. An improvement of the space uniformity of the light output, the time fluctuation of the light output as well as the light yield can therefore be achieved and thus a dielectric barrier discharge lamp with a smaller shape in comparison to the above-described embodiment can be obtained.

Figure 5:
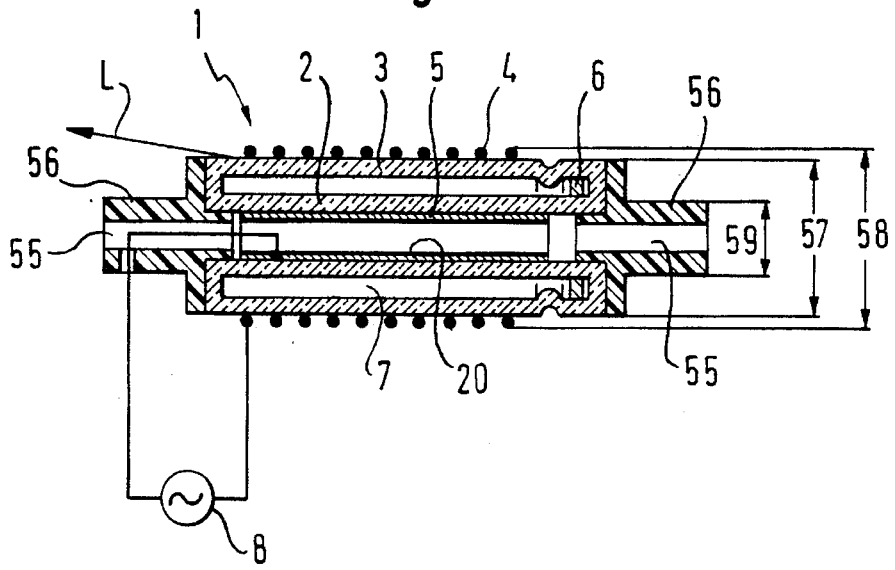
FIG. 5 is a diagrammatic representation of an embodiment of the dielectric barrier discharge lamp according to the invention.

Next, embodiments for achieving the second object of the invention are shown in FIG. 5:

The same reference symbols as in FIG. 1 designate the same parts as in FIG. 1.

A holder 56 made of silicone rubber, provided with an air outlet orifice 55 is arranged on the two ends of discharge vessel 1. This holder 56 is placed on discharge vessel 1 by an adhesive based on silicone rubber, which is not represented in the drawing. A reference symbol 20 designates a protective film made of silicone rubber as an additional component for the purpose of mechanical and chemical protection of the aluminum electrode 5.

Since an outer diameter 57 of holder 56 is less than outer diameter 58 of cylindrical, netlike electrode 4, the above-described dielectric barrier discharge lamp's own light L, which is radiated in a direction adjacent to a tube axis of external tube 3 of discharge vessel 1, can be used effectively by the holder without interruption. Holder 56 can further be incorporated in another component in a simple and exact way, since it comprises a part with a smaller diameter 59.

By the flowing-in of a nitrogen gas in air outlet opening 55 arranged in holder 56 and cooling the lamp, a dielectric barrier discharge lamp with high efficiency can further be obtained, in which no lowering of the light yield occurs in a light fixture operation by using an electric input, which is three times as high as in the above-described example.

Moreover, there is the advantage that the placing of the holder on discharge vessel 1 can be performed in a simple way and at the same time, an adequate service life because of a sufficient resistance to the ultraviolet rays in a wavelength range of 172 nm as well as in the range of this wavelength can be obtained, since the holder consists of silicone rubber and thus has an elasticity.

The same effect as in the above-described embodiment could also be obtained when using a holder made of fluororesin instead of silicone rubber. Further, by using a holder made of ceramic or metal, the light coefficient of utilization can be increased and the lamp can be positioned in a simple and exact way.

Figure 6:
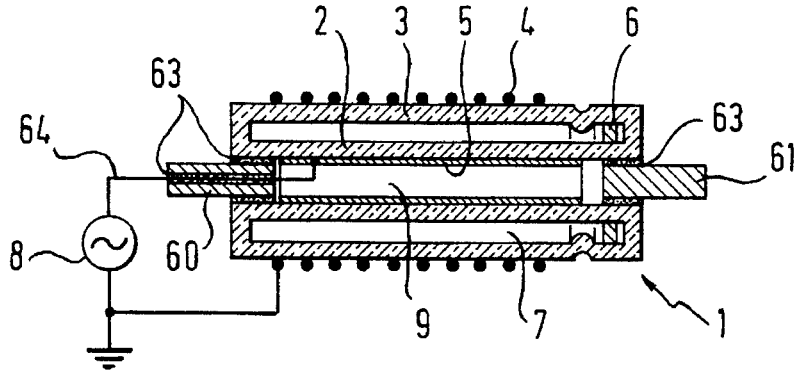
FIG. 6 is a diagrammatic representation of an embodiment of the dielectric barrier discharge lamp according to the invention.

Next, embodiments for achieving the third object of the invention are shown in FIG. 6:

The same reference symbols as in FIG. 1 designate the same parts as in FIG. 1.

A holder 60 made of aluminum oxide is placed on the two ends of discharge vessel 1 by means of an adhesive based on silicone rubber 63. An orifice is arranged in holder 60, orifice through which a line 64 goes, to which high voltage is applied. A gap between the orifice and line 64 is also hermetically sealed by the adhesive based on silicone rubber 63, and as a result, the line is also fastened at the same time.

In this embodiment, the emission of air present on an inner side 9 does not occur by steps in the given atmosphere, such as nitrogen or the like, by the measure in which interior 9 of internal tube 2 is hermetically sealed by holder 60. The contamination of the nitrogen atmosphere by the air therefore does not occur either.

According to the invention, a dielectric barrier discharge lamp with a high reliability can furthermore be indicated, since no more air flows on electrode 5, to which the high voltage was applied, therefore no dust accumulates and no contamination of the object to be treated occurs.

Figure 7:
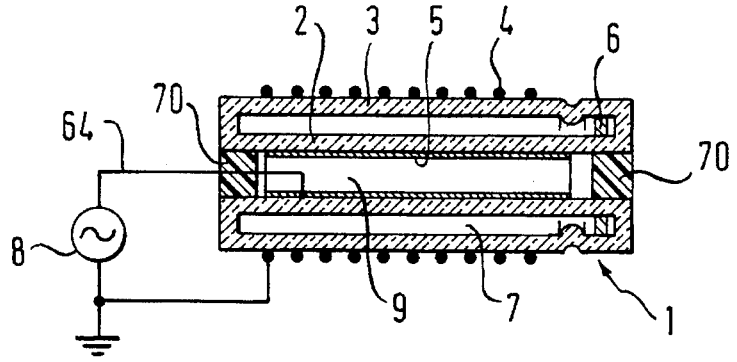
FIG. 7 is a diagrammatic representation of another embodiment of the dielectric barrier discharge lamp according to the invention.

FIG. 7 illustrates another embodiment. Silicone rubber 70 was injected on the two inside ends of interior 9 of internal tube 2 of discharge vessel 1, and interior 9 of internal tube 2 was hermetically sealed. In this case, the advantage has been obtained that a sufficient service life is achieved, or advantages of this kind, since silicone rubber 70 has good adhesive properties, can be used at the same time in a simple way and has sufficient resistance to the ultraviolet rays with 172 nm and in the range of this wavelength. Also in this case, line 64 is fastened to a side of the high voltage and at the same time by means of silicone rubber 70.

Figure 8:
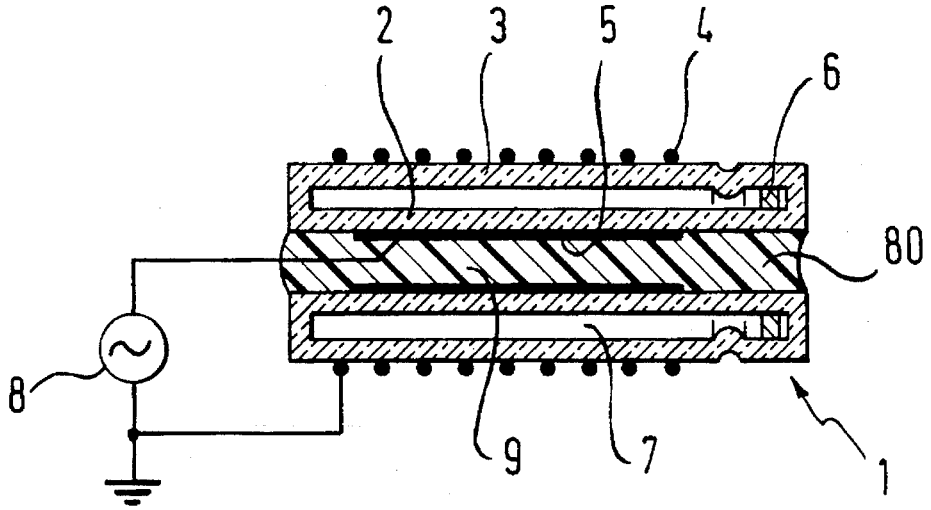
FIG. 8 is a diagrammatic representation of still another embodiment of the dielectric barrier discharge lamp according to the invention.

FIG. 8 shows still another embodiment. Silicone rubber 80 was injected in entire interior 9 of internal tube 2, and interior 9 of internal tube 2 was hermetically sealed. As a result, a dielectric barrier discharge lamp with an even higher reliability can be obtained, since no more air is present inside interior 9 and thus no more problem of leakage occurs in the hermetically sealed part.

Figure 9:
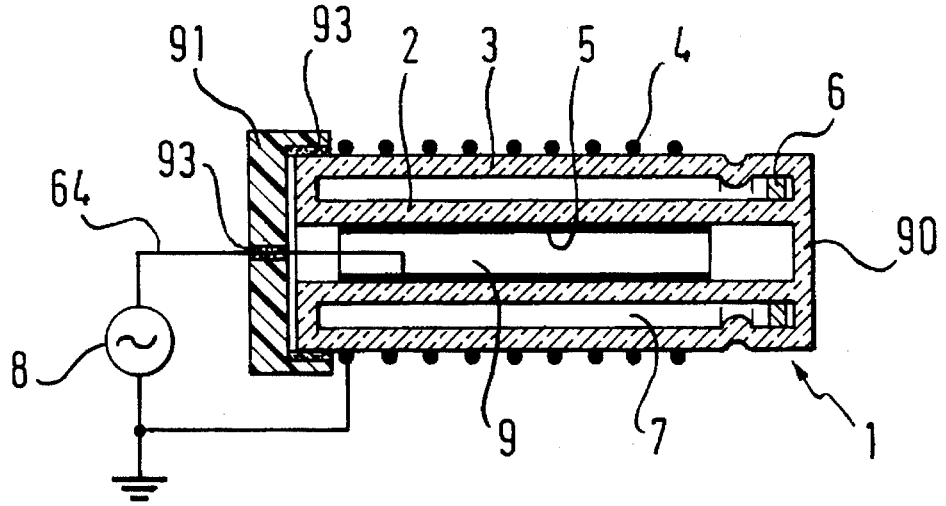
FIG. 9 is a diagrammatic representation of still another embodiment of the dielectric barrier discharge lamp according to the invention.

In FIG. 9, still another embodiment is illustrated. On one end on a side of getter 6 of discharge vessel 1, a wall 90 was formed by lengthening the glass forming discharge vessel 1 and was hermetically sealed. This means that glass wall 90 in discharge vessel 1 was applied as deposition. A holder 91 made of silicone rubber was placed by means of an adhesive based on silicone rubber 93 on another end of discharge vessel 1. In this embodiment, there is the advantage that a simpler arrangement can be obtained.

Figure 10:
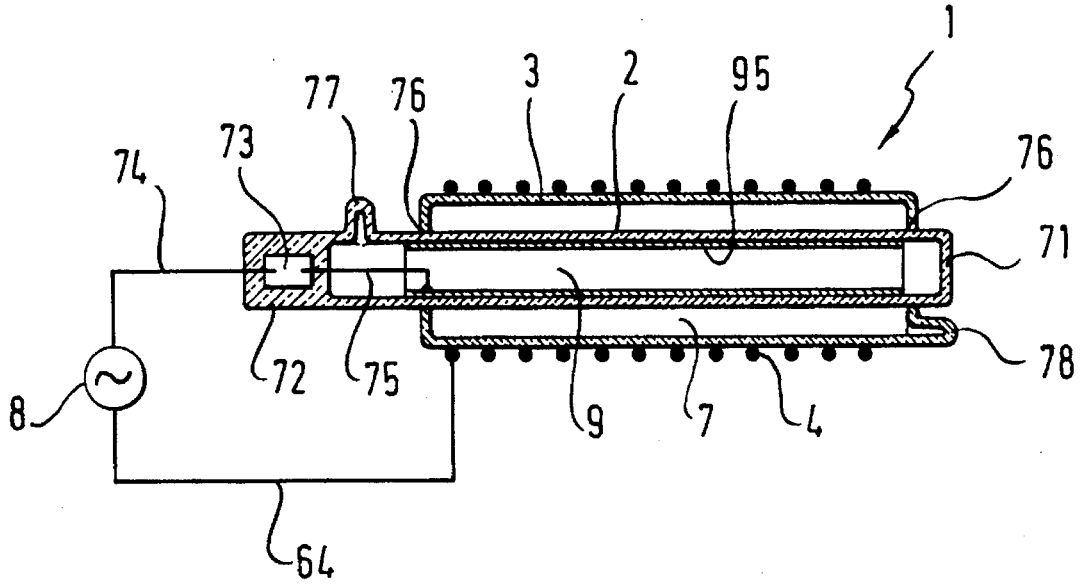
FIG. 10 is a diagrammatic representation of still another embodiment of the dielectric barrier discharge lamp according to the invention.
Figure 11:
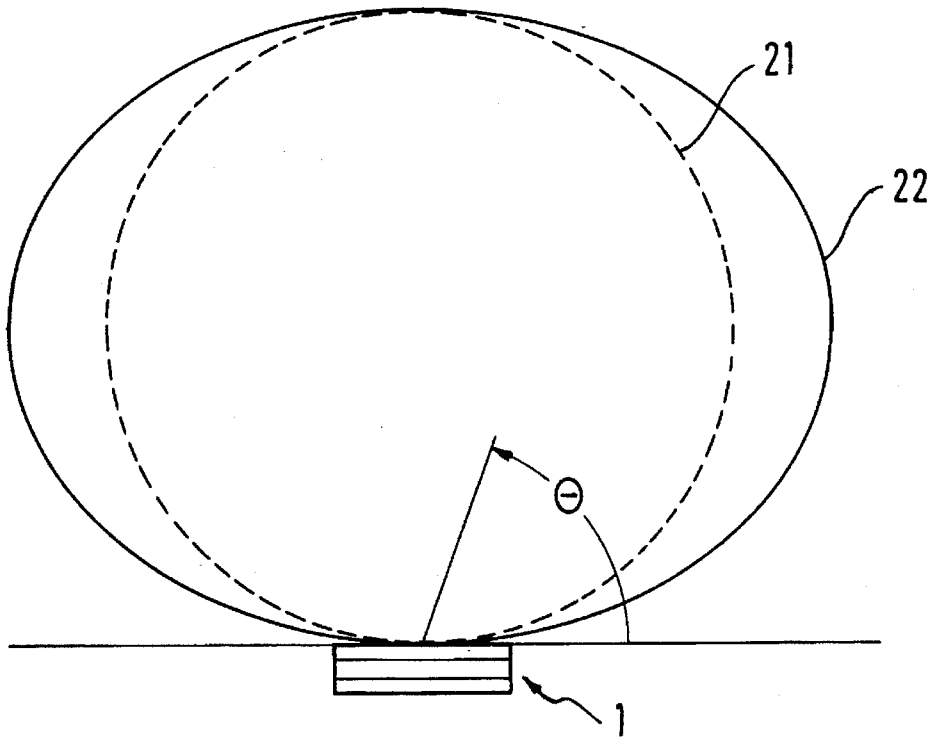
FIG. 11 is a diagrammatic representation of a light distribution.

FIG. 10 shows diagrammatically still another embodiment. An end 71 of internal tube 2 is closed. A side of internal tube 2, which comes in contact with interior 9, is provided with two groovelike mirrors 95 made of aluminum, so that a cylindrical aluminum mirror is arranged as a whole. Another end 72 of internal tube 2 is a hermetically sealed part, in which a molybdenum metal foil 73 is inserted, from which an outside connection 74 extends outward and an inside connection 75 extends inward. Inside connection 75 is connected to above-described aluminum mirror 95. A power supply for aluminum mirror 95 can therefore be made coming from outside connection 74. This means that mirror 95 also has the function of an electrode.

Both ends 76 of external tube 3 are fused with internal tube 2. A reference symbol 77 designates a residual part of an air outlet tube, which was used in a filling process of the nitrogen gas after evacuation of interior 9 of internal tube 2. Aluminum mirror 95 is therefore protected by an inactive gas, such as nitrogen. A reference symbol 78 designates a residual part of an air outlet tube, which was used in a filling process of a gas, necessary for the discharge, after evacuating discharge space 7 between internal tube 2 and external tube 3. In this embodiment, the advantage is that the lamp can be produced in a very simple way.

EFFECT OF THE INVENTION

As described above, a good space uniformity of the light output as well as a good time stability of the light output and at the same time a high light yield can be obtained by the dielectric barrier discharge lamp according to the invention.

Further, a sufficient light coefficient of utilization and at the same time simple maintenance of the lamp can be achieved according to the invention.

Moreover, the contamination of the given atmosphere by air or the like for using the lamp can be prevented according to the invention.

It is to be understood that although preferred embodiments of the invention have been described, various other embodiments and variations may occur to those skilled in the art. Any such other embodiments and variations which fall within the scope and spirit of the present invention are intended to be covered by the following claims.

What we claim is:

1. A dielectric barrier discharge lamp comprising a discharge vessel having walls enclosing a discharge space which is filled with a discharge gas forming excimer molecules by a dielectric barrier discharge, in which at least part of the discharge vessel also forms a dielectric of the dielectric barrier discharge, in which an outer one of said walls of the discharge vessel is at least partially transparent relative to light radiated from the excimer molecules, and in which the dielectric is at least partially provided with electrodes, a first of said electrodes being arranged along an outer side of the outer wall of the discharge vessel which forms the dielectric and laying tightly thereagainst, and a second of the electrodes being arranged in contact with an inner side of an inner one of said walls of the discharge vessel; wherein an average thickness of electrode ends of the first of said electrodes is greater than the average thickness of the first of said electrodes as a whole.

2. A dielectric barrier discharge lamp according to claim 1, wherein the average thickness of electrode ends is greater than the average thickness of the electrodes as a whole as a result of the electrode ends having been folded.

3. A dielectric barrier discharge lamp according to claim 1, wherein the first electrode is comprised of a seamless, cylindrical, conductive netting, which is resilient in an axial direction of the discharge lamp.

4. A dielectric barrier discharge lamp according to claim 1, wherein a conductive paste is applied to the electrode ends.

5. A dielectric barrier discharge lamp comprising a discharge vessel having walls enclosing a discharge space which is filled with a discharge gas forming excimer molecules by a dielectric barrier discharge, in which at least part of the discharge vessel also forms a dielectric of the dielectric barrier discharge and is at least partially transparent relative to light radiated from the excimer molecules, and in which the dielectric is at least partially provided with electrodes, a first electrode of which is arranged on an outer side of the part of the discharge vessel which forms the dielectric and a second electrode of which is arranged at an opposite side of the part of the discharge vessel which forms the dielectric from said first electrode; and wherein the average thickness of electrode ends of said first electrode is greater than the average thickness of the first electrode as a whole by the electrode ends having been wrapped with a material from the group consisting of a wire, a twisted wire, a metal strip and a strip made of metal netting.

6. A dielectric barrier discharge lamp according to claim 5, wherein an electrode lead is connected to said material with which the electrode ends are wrapped.

7. A dielectric barrier discharge lamp, comprising a discharge vessel having an approximately cylindrical shape and filled with a discharge gas forming excimer molecules by a dielectric barrier discharge, in which an outer wall of the discharge vessel is at least partially transparent to light radiated from the excimer molecules and forms a light-transmitting dielectric of the dielectric barrier discharge, and in which the light-transmitting dielectric is at least partially provided with electrodes, one of the electrodes being arranged on an outer side of the outer wall of said discharge vessel and a second electrode of which is arranged at an opposite side of the part of the discharge vessel which forms the dielectric from said first electrode; wherein a holder is arranged on at least one end of the discharge vessel, said holder having an outer diameter which is less than or equal to an outer diameter of said one of the electrodes which is arranged on an outer side of the outer wall of the discharge vessel which forms the light-transmitting dielectric.

8. A dielectric barrier discharge lamp according to claim 7, wherein the holder has an air outlet orifice for cooling the lamp.

9. A dielectric barrier discharge lamp according to claim 8, wherein the holder is formed of a material selected from the group consisting of silicone rubber and a fluororesin.

10. A dielectric barrier discharge lamp, comprising a discharge vessel formed of coaxially arranged and connected external and internal tubes which have an approximately cylindrical shape, and which define a hollow cylindrical discharge space therebetween which is filled with a discharge gas forming excimer molecules by a dielectric barrier discharge; wherein the external tube of the discharge vessel is at least partially transparent to light radiated from the excimer molecules and forms a light-transmitting dielectric of the dielectric barrier discharge; wherein the light-transmitting dielectric is at least partially provided with electrodes, one of the electrodes being arranged on an outer side of the external tube of the discharge vessel and a second electrode of which is arranged at an inner side of the internal tube of the discharge vessel; and wherein an interior of the internal tube is hermetically sealed.

11. Dielectric barrier discharge lamp according to claim 10, wherein the internal tube is hermetically sealed by a holder of the dielectric barrier discharge lamp.

12. Dielectric barrier discharge lamp according to claim 10, wherein the internal tube is hermetically sealed by at least one material which is selected from the group consisting of a ceramic and a resin and which is bonded to the discharge vessel.

13. Dielectric barrier discharge lamp according to claim 10, wherein the internal tube is hermetically sealed by a component which is formed of a material that is approximately the same as a material of which the internal tube is formed and which is deposited therein.

14. Dielectric barrier discharge lamp according to claim 10, wherein both ends of the internal tube are sealed in the same manner.

15. Dielectric barrier discharge lamp according to claim 10, wherein the internal tube is hermetically sealed with silicone rubber.

16. Dielectric barrier discharge lamp according to claim 15, wherein the silicone rubber with which the internal tube is hermetically sealed fills the interior of the above-described internal tube.

17. Dielectric barrier discharge lamp according to claim 10, wherein one of the electrodes is arranged on the interior of the internal tube, a high voltage being applied thereto; and wherein another of the electrodes is grounded.

18. Dielectric barrier discharge lamp according to claim 10, wherein an electrode lead is connected to the electrodes, and wherein the electrode lead is fastened in a hermetically sealed part of the internal tube.

19. Dielectric barrier discharge lamp according to claim 10, wherein one of said electrodes is an aluminum electrode which is arranged inside the internal tube, said electrode also functioning as a mirror; and wherein a metal foil is inserted in a hermetically sealed part of the interior of the internal tube at at least one end thereof, said metal foil forming a means feeding energy to the aluminum electrode.

* * * * *